US009217947B2

(12) United States Patent
Morita et al.

(10) Patent No.: US 9,217,947 B2
(45) Date of Patent: Dec. 22, 2015

(54) IMAGE FORMING DEVICE

(71) Applicant: CANON KABUSHIKI KAISHA, Tokyo (JP)

(72) Inventors: Tomokazu Morita, Mishima (JP); Takeyoshi Saiga, Tokyo (JP); Yu Miyajima, Utsunomiya (JP); Seiji Mishima, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/747,970

(22) Filed: Jun. 23, 2015

(65) Prior Publication Data

US 2015/0293468 A1 Oct. 15, 2015

Related U.S. Application Data

(63) Continuation of application No. 14/315,034, filed on Jun. 25, 2014, now Pat. No. 9,091,954.

(30) Foreign Application Priority Data

Jun. 28, 2013 (JP) ..... 2013-136161

(51) Int. Cl.

| | |
|---|---|
| ***G03G 15/01*** | (2006.01) |
| ***G03G 15/04*** | (2006.01) |
| ***G03G 15/043*** | (2006.01) |

(52) U.S. Cl.
CPC ..... *G03G 15/04036* (2013.01); *G03G 15/043* (2013.01)

(58) Field of Classification Search
USPC ..... 347/236–238, 246, 247, 130, 118; 313/500, 504, 508; 315/169.1, 169.3; 381/61; 428/523
See application file for complete search history.

(56) References Cited

U.S. PATENT DOCUMENTS

| | | | | |
|---|---|---|---|---|
| 7,466,327 | B2 * | 12/2008 | Kitazawa | 347/238 |
| 7,768,196 | B2 * | 8/2010 | Kobayashi | 313/504 |
| 2005/0280694 | A1 * | 12/2005 | Tsujino et al. | 347/238 |
| 2008/0038572 | A1 * | 2/2008 | Goto et al. | 428/523 |

* cited by examiner

*Primary Examiner* — Kristal Feggins
(74) *Attorney, Agent, or Firm* — Canon USA, Inc. IP Division

(57) ABSTRACT

An exposure unit includes a lens group having a plurality of lenses arrayed in a first direction and an element array which is arranged to face the lens group and includes a plurality of organic EL elements arrayed in parallel with the first direction on a substrate, a drive circuit including a plurality of TFT circuits for controlling luminance per unit time of the organic EL element is arranged on the substrate, and the TFT circuit controls the luminance of the organic EL element based on a signal created by an area gray scale method.

8 Claims, 20 Drawing Sheets

IMAGE FORMING DEVICE

This application is a continuation application and claims the benefit of priority Japanese Patent Application No. 2013-136161, filed Jun. 28, 2013 and U.S. patent application Ser. No. 14/315,034 filed Jun. 25, 2014 which are hereby incorporated by reference herein in its entirety.

BACKGROUND

1. Technical Field

The present disclosure relates to an image forming device.

2. Description of the Related Art

As an exposure head which selectively exposes a photosensitive body and which is used in an image forming device such as a printer using an electrophotographic process, a configuration including a light-emitting element array and a microlens array is proposed as in Japanese Patent Application Laid-Open No. 2011-110762. As the light-emitting element, a Light Emitting Diode (LED) element, an organic Electro Luminescence (EL) element, or the like is used. In particular, when an organic EL element array is used as the exposure head, it is not necessary to arrange light-emitting elements with high accuracy as in the LED element array and the light-emitting elements can be monolithically formed on a substrate, so that it is possible to reduce the cost.

On the other hand, an image signal of each pixel in the light-emitting element array is determined by an area gray scale method such as a dither method and an error diffusion method in a gray scale presentation of a halftone image. Japanese Patent Application Laid-Open No. 2002-16802 proposes creating an image signal by a multi-value area gray scale method.

As a typical method of gray scale control of each light-emitting element, there is a pulse width modulation that controls the exposure time.

To perform the pulse width modulation, the number of thin film transistors (TFTs), which are elements of a peripheral circuit or a pixel circuit, increases, so that a decrease in yield and an increase in a substrate area according to an increase in the area of the entire area in which the TFTs are formed occur. Therefore, there is a problem that the cost increases.

SUMMARY

Therefore, an object of the present invention is to provide an image forming device which is low cost and which provides a stable gray scale representation.

An image forming device of the present invention is an image forming device including a photosensitive body, a charging unit that charges the photosensitive body, an exposure unit that forms an electrostatic latent image on a surface of the photosensitive body, a developing unit that develops the electrostatic latent image as a toner image, a transfer unit that transfers the toner image to a transfer target member, and a fixing unit that fixes the transferred toner image to the transfer target member. The exposure unit includes a lens group having a plurality of lenses arrayed in a first direction and an element array which is arranged to face the lens group and includes a plurality of organic EL elements arrayed in parallel with the first direction on a substrate. A drive circuit including a plurality of transistor circuits that control luminance per unit time of each of the plurality of organic EL elements is arranged on the substrate of the element array. The transistor circuit controls the luminance of the organic EL element based on a signal created by an area gray scale method.

Further features of the present invention will become apparent from the following description of exemplary embodiments (with reference to the attached drawings).

DESCRIPTION OF THE EMBODIMENTS

Hereinafter, an embodiment of the present invention will be described in detail with reference to the drawings.

[Electrophotographic Image Forming Device]

Figure 1:
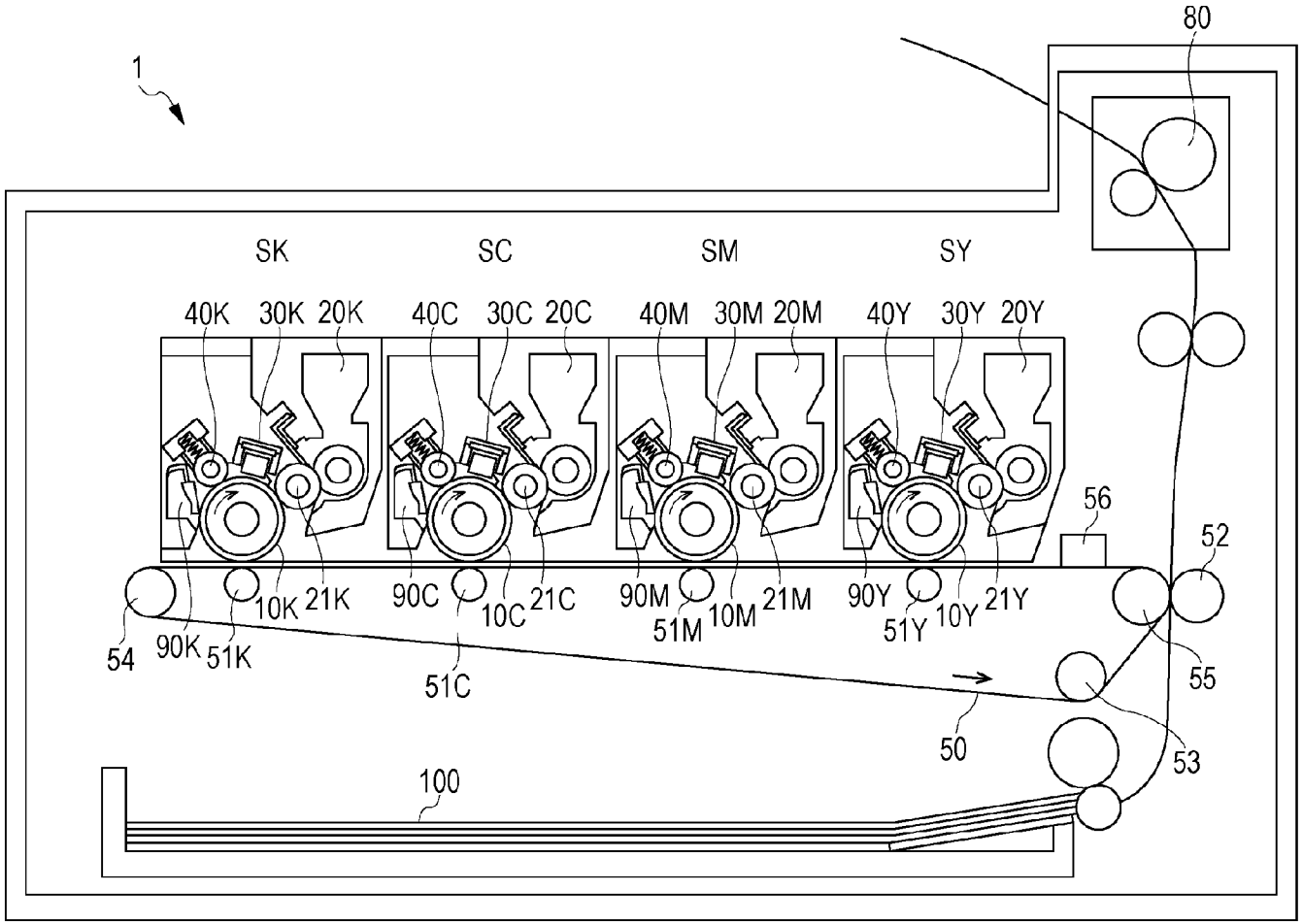
FIG. 1 is a schematic diagram illustrating an example of an image forming device according an embodiment.

An image forming device of the embodiment will be described with reference to FIG. 1. FIG. 1 is a schematic cross-sectional view of an image forming device 1 of the embodiment. The image forming device 1 of the embodiment is a full color laser printer that employs an inline system and an intermediate transfer system.

The image forming device 1 can form a full color image on a recording paper 100 (for example, a recording paper, a plastic sheet, and a cloth) according to image information. The image information is inputted into the image forming device 1 from an image reading device (not illustrated in the drawings) connected to the image forming device 1 or a host device such as a personal computer communicably connected to the image forming device 1. The image forming device 1 includes first, second, third, and fourth image forming units SY, SM, SC, and SK for forming images of colors of yellow (Y), magenta (M), cyan (C), and black (K). In the embodiment, the first to the fourth image forming units SY, SM, SC, and SK are arranged in a row in the horizontal direction. In the embodiment, configurations and operations of the first to the fourth image forming units SY, SM, SC, and SK are substantially the same except that the color of the formed image is different. Hereinafter, when the first to the fourth image forming units need not be distinguished from each other, the suffixes Y, M, C, and K, which are given to reference numerals to represent that an element is provided for any one of the colors in FIG. 1, are omitted, and the image forming units will be collectively described.

In the embodiment, the image forming device 1 includes four drum-shaped electrophotographic photosensitive bodies juxtaposed in the horizontal direction, that is, photosensitive drums 10, as a plurality of image carriers. The photosensitive drum 10 is driven and rotated by a drive unit (drive source) not illustrated in FIG. 1 in the arrow direction (clockwise direction) in FIG. 1.

A charging roller 40 used as a charging unit is arranged around the photosensitive drum 10. The charging roller 40 uniformly negatively charges the surface of the photosensitive drum 10.

Next, an exposure head 30 used as an exposure unit that forms an electrostatic latent image on the photosensitive drum 10 by irradiating light based on an image signal is arranged. A predetermined portion on the photosensitive drum 10 is exposed by the exposure head 30 and the charge at the predetermined portion on the photosensitive drum 10 is reduced.

Further, a developing unit 20 used as a developing unit that develops the electrostatic latent image as a toner image is arranged around the photosensitive drum 10. In the embodiment, the developing unit 20 uses non-magnetic one-component developer, that is, toner, as developer. In the embodiment, the developing unit 20 performs development by causing a developing roller 21 used as a developer carrier to come into contact with the photosensitive drum 10. Specifically, in the embodiment, a voltage of the same charging polarity (negative polarity in the embodiment) as the charging polarity of the photosensitive drum 10 is applied to the developing roller 21 in the developing unit 20. Therefore, an electric field is generated between the developing roller 21 and the photosensitive drum 10 connected to the earth and negatively charged toner is attached to a portion (image portion, exposure potion), where the charge is reduced by exposure, on the photosensitive drum 10, so that the electrostatic latent image is developed.

Further, an intermediate transfer belt 50 used as an intermediate transfer body (a transfer target member) for transferring the toner image on the photosensitive drum 10 to a recording paper 100 is arranged to face the four photosensitive drums 10. Here, the intermediate transfer belt 50 formed by an endless type belt used as an intermediate transfer body is in contact with all the photosensitive drums 10 and circularly moves (rotates) in the arrow direction (counterclockwise direction) in FIG. 1. The intermediate transfer belt 50 is stretched between a plurality of support members, primary transfer rollers 51, a secondary transfer counter roller 55, a driven roller 53, and a driving roller 54. On the inner circumferential surface side of the intermediate transfer belt 50, four primary transfer rollers 51 used as primary transfer units are juxtaposed to face each photosensitive drum 10. The primary transfer roller 51 presses the intermediate transfer belt 50 to the photosensitive drum 10 and forms the primary transfer unit in which the intermediate transfer belt 50 and the photosensitive drum 10 abut each other. Bias having the polarity opposite to the charging polarity of the toner is applied to the primary transfer roller 51 from a primary transfer bias power supply (high-voltage power supply) used as a primary transfer bias application unit not illustrated in FIG. 1. Thereby, the toner image on the photosensitive drum 10 is transferred (primarily transferred) onto the intermediate transfer belt 50.

On the outer circumferential surface side of the intermediate transfer belt 50, a secondary transfer roller used as a secondary transfer unit is arranged at a position facing the secondary transfer counter roller 55. The secondary transfer roller 52 abuts and presses the secondary transfer counter roller 55 through the intermediate transfer belt 50 and forms the secondary transfer unit in which the intermediate transfer belt 50 and the secondary transfer roller 52 abut each other. Bias having the polarity opposite to the normal charging polarity of the toner is applied to the secondary transfer roller 52 from a secondary transfer bias power supply (high-voltage power supply) used as a secondary transfer bias application unit not illustrated in FIG. 1. Thereby, the toner image on intermediate transfer belt 50 is transferred (secondarily transferred) to the recording paper 100 fed from a paper feeding unit.

Further, a cleaning unit 90 that cleans toner (transfer residual toner) remaining on the surface of the photosensitive drum 10 after the transfer is arranged.

In this way, in the rotation direction of the photosensitive drum 10, charging, exposure, development, transfer, and cleaning are performed in this order.

Finally, the recording paper 100 on which the toner image is transferred is supplied to a fixing device 80 used as a fixing unit. In the fixing device 80, heat and pressure are applied to the recording paper 100, so that the toner image is fixed to the recording paper 100.

Secondary transfer residual toner remaining on the intermediate transfer belt 50 after the secondary transfer process is cleaned by an intermediate transfer belt cleaning device 56.

The image forming device 1 can form a single color image or a multi-color image by using desired one or several (not all) image forming units.

The configuration of the image forming device described above is only an example for describing the embodiment and is not limited according to the gist of the present invention.

Figure 2A:
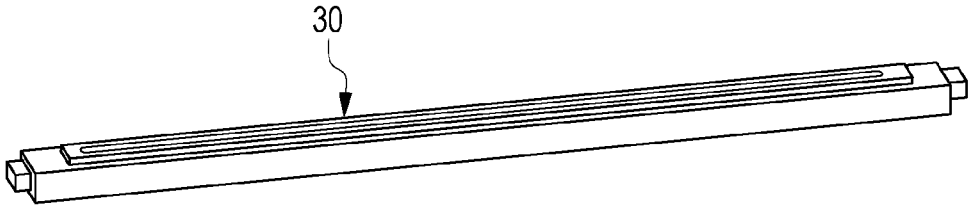
FIGS. 2A and 2B are schematic diagrams illustrating an exposure head used in the image forming device according to the embodiment.
Figure 2B:
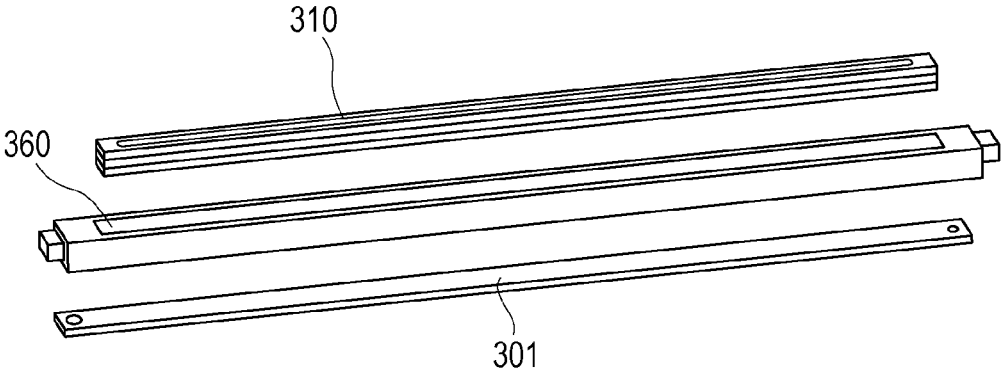

Next, the exposure head 30 will be described. FIG. 2A illustrates an assembly view of the exposure head 30. FIG. 2B illustrates an exploded view of the exposure head 30. As illustrated in FIG. 2B, the exposure head 30 includes an element array 301 in which a plurality of organic EL elements are arranged, a frame body 360, and a lens group 310. The element array 301 and the lens group 310 are aligned at appropriate positions determined by a focal length of the lens group 310 and positioned and fixed to frame body 360.

Figure 3:
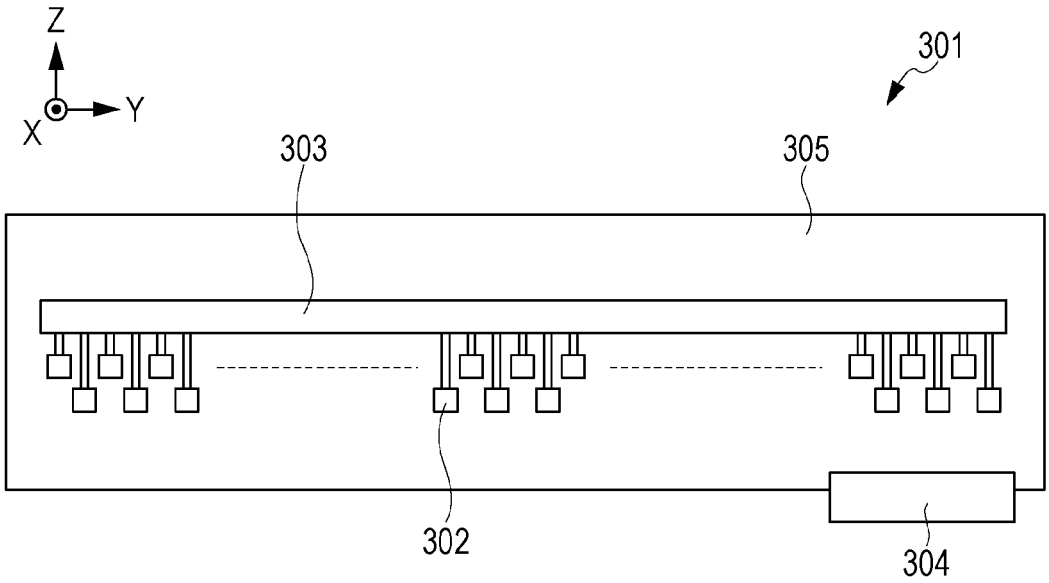
FIG. 3 is a schematic diagram illustrating an example of an element array of the exposure head according to the embodiment.

FIG. 3 illustrates a detailed diagram of the element array 301. In FIG. 3, the element array 301 includes a substrate 305, a plurality of organic EL elements 302 arranged on the substrate 305, a drive circuit 303 for driving the plurality of organic EL elements 302, and a connector 304. Specifically, the drive circuit 303 and the plurality of organic EL elements 302 are monolithically formed on the substrate 305.

In the embodiment, the organic EL element 302 is a bottom emission type element and light is emitted through the substrate 305. The plurality of organic EL elements 302 are sealed by a sealing member (not illustrated in FIG. 3). As illustrated in FIG. 3, the plurality of organic EL elements 302 are arranged zigzag in the Y direction on the substrate 305. The light emitting timing of each organic EL element 302 is controlled by the drive circuit 303, so that spots exposed by the organic EL elements 302 are arranged in a straight line on the photosensitive drum 10. At this time, the arrangement positions of the organic EL elements 302 and the position and shape of the lens group 310 are designed so that the spots on the photosensitive drum 10 slightly overlap each other. The plurality of organic EL elements 302 may be arranged in a row instead of being arrayed zigzag.

The connector 304 is electrically connected to the drive circuit 303 by wiring and connected to a control board of a main body of the image forming device not illustrated in FIG. 3 with a cable. The organic EL element 302 emits light according to a data signal inputted from the control board of the main body through the connector 304. Specifically, a value of current flowing through each organic EL element 302 is controlled by the drive circuit 303 according to an image signal, so that the organic EL elements 302 are selectively caused to emit light at a desired luminance.

Figure 4:
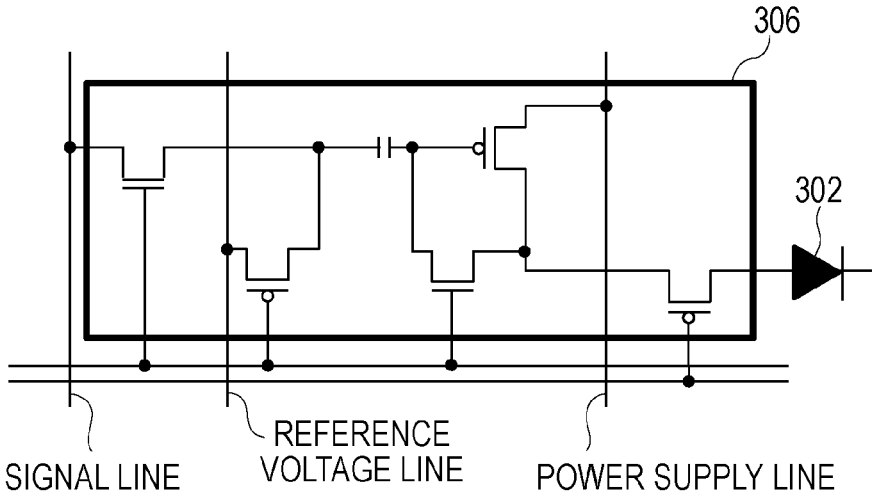
FIG. 4 is a schematic diagram of a circuit for driving an organic EL element when performing amplitude modulation.

FIG. 4 illustrates a TFT circuit (transistor circuit) 306 included in the drive circuit 303 illustrated in FIG. 3. Here, the TFT circuit 306 is a circuit for driving one organic EL element 302 and controls light emission of the organic EL element 302. The drive circuit 303 includes the TFT circuits 306, the number of which is equal to the number of the organic EL elements. The signal line, the reference voltage line, and the power supply line are commonly connected to each TFT circuit 306.

The TFT circuit 306 includes five TFT elements. The five TFT elements are connected as illustrated in FIG. 4, so that the TFT circuit 306 controls the value of current flowing through the organic EL element 302 according to the data signal transmitted through the signal line. The organic EL element 302 emits light at a luminance according to the current value supplied from the TFT circuit. By this configuration, the organic EL element 302 emits light at a luminance corresponding to the image signal. As illustrated in FIG. 4, the TFT circuit 306 of the embodiment has a configuration of controlling a luminance per unit time of the organic EL element 302 (hereinafter referred to as amplitude), specifically, a configuration of controlling the value of current flowing through the organic EL element 302, for gray scale representation. This configuration is referred to as amplitude modulation.

Figure 5:
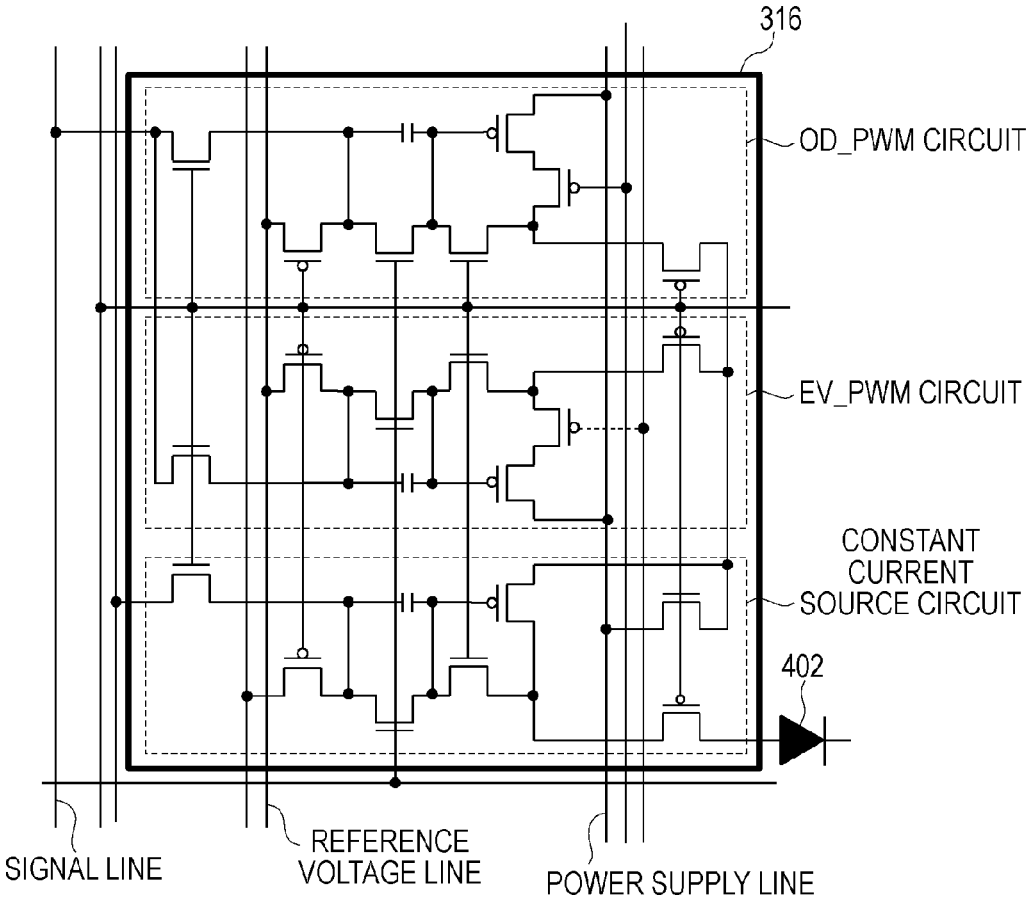
FIG. 5 is a schematic diagram of a circuit for driving an organic EL element when performing pulse width modulation.

On the other hand, a TFT circuit 316 illustrated in FIG. 5 (portion surrounded by a thick line) has a configuration of controlling a light emitting time of the organic EL element 302 in the same manner as in a normal laser scanner. This configuration is referred to as pulse width modulation. As illustrated in FIG. 5, the TFT circuit 316 requires a constant current source circuit having the same configuration as that of the TFT circuit 306 illustrated in FIG. 4. Further, the TFT circuit 316 requires an EV_PWM circuit and an OD_PWM circuit to drive the constant current source circuit in a time-division manner. Therefore, the circuit scale of the TFT circuit 316 for performing the pulse width modulation increases. Specifically, the TFT circuit 316 requires 21 TFT elements, the number of which is about four times the number of TFT elements of the TFT circuit 306 illustrated in FIG. 4.

In other words, in the case of the TFT circuit 306 that performs the amplitude modulation as in the embodiment, the number of TFT elements can be smaller than that of the TFT circuit 316 that performs the pulse width modulation. Therefore, in the case of the embodiment, it is possible to reduce the area where the drive circuit 303 is formed, so that it is possible to reduce the area of the substrate 305. When the area of the substrate 305 is reduced, the number of the element arrays 301 obtained from one large substrate can be increased, so that it is possible to reduce the cost.

When an LED element is used as a light emitting element, it is difficult to form a transistor circuit that controls a luminance per unit time of the organic EL element 302 on the same substrate on which a plurality of light emitting elements are arranged as in the embodiment. This is because the substrate on which the LED elements are formed is generally a GaAs substrate and a GaN substrate, so that it is difficult to form a transistor circuit. Therefore, when an LED element is used as a light emitting element, the size of an external circuit such as a main controller and a head controller increases. On the other hand, when the organic EL elements 302 and the drive circuit 303 (TFT circuits 306) are formed on the same glass substrate or Si substrate as in the embodiment, it is possible to reduce the size of external circuit and thus reduce the cost.

Figure 6:
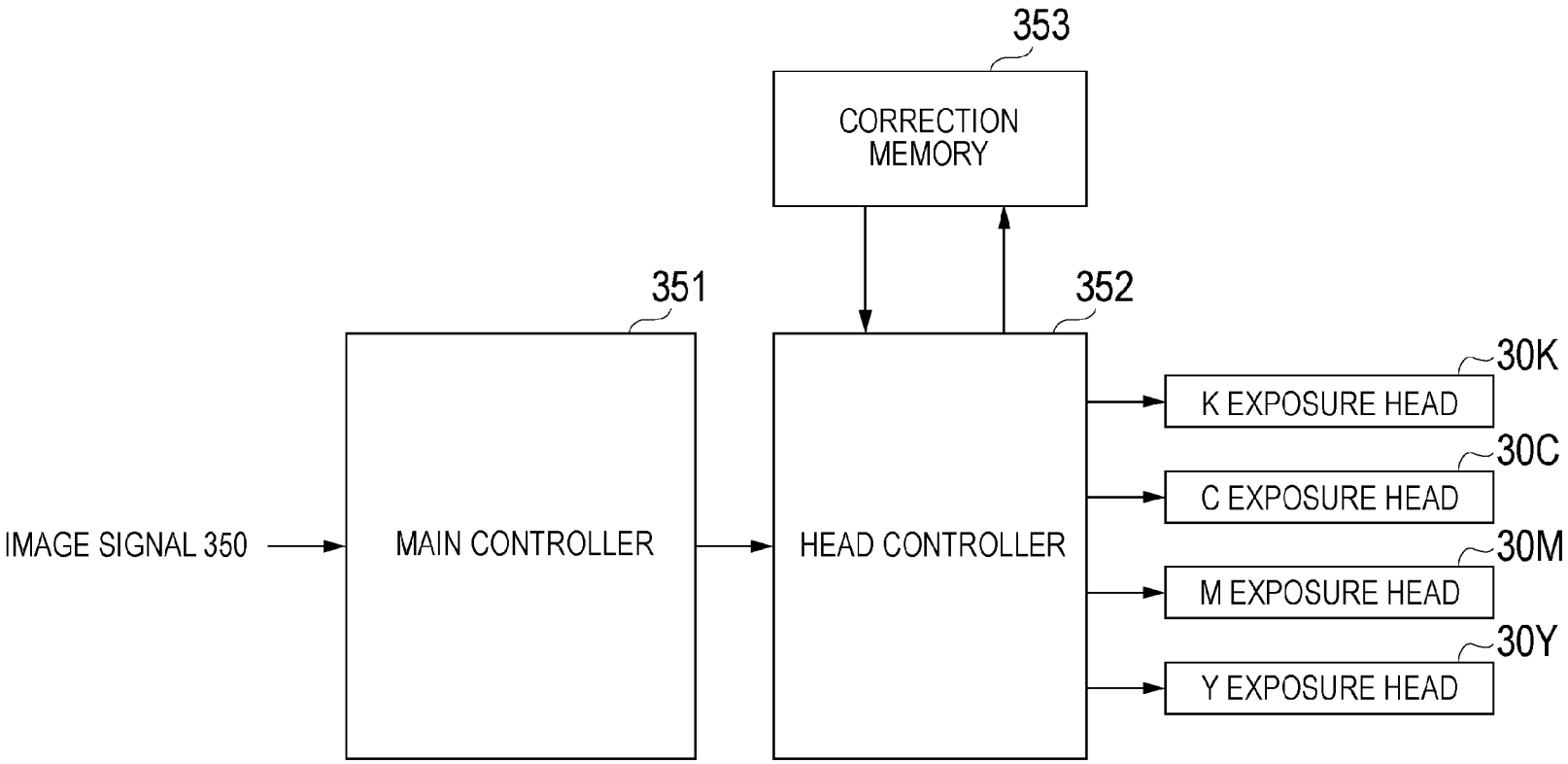
FIG. 6 is a schematic diagram for explaining image processing of the image forming device according to the embodiment.

Next, FIG. 6 illustrates a processing path of an image signal inputted from outside for explaining the data signal inputted when causing the organic EL element 302 to emit light. The image signal 350 inputted from an external device such as a host computer is held by a main controller 351 including a CPU and a memory. Thereafter, the main controller 351 transmits a control signal that operates the image forming device 1 and provides the image signal 350 to the head controller 352. The head controller 352 converts the image signal 350 into multi-value area gray scale signals corresponding to the exposure heads 30K, 30C, 30M, and 30Y for each color by the area gray scale method while referring to light amount correction data in a correction memory 353. Thereafter, considering that the organic EL elements 302 are arranged zigzag, processing to adjust the order of signals to be written is performed so that the exposure is performed in a straight line on the photosensitive drum 10, and the area gray scale signal is transmitted to the exposure heads 30K, 30C, 30M, and 30Y arranged for each color. The drive circuit 303 transmits a data signal corresponding to each organic EL element to a signal line connected to each TFT circuit 306 on the basis of the area gray scale signal and controls the luminance per unit time of each organic EL element on the basis of the data signal.

Next, the image forming device of the embodiment performs gray scale representation of a halftone image by combining a binary area gray scale method and the amplitude modulation method as a multi-value area gray scale method. Hereinafter, the gray scale representation of the embodiment will be described. The effect of combining the binary area gray scale method and the amplitude modulation method will be also described by comparing with a gray scale representation obtained by combining the binary area gray scale method and the pulse width modulation method as a multi-value area gray scale method.

Figure 7A:
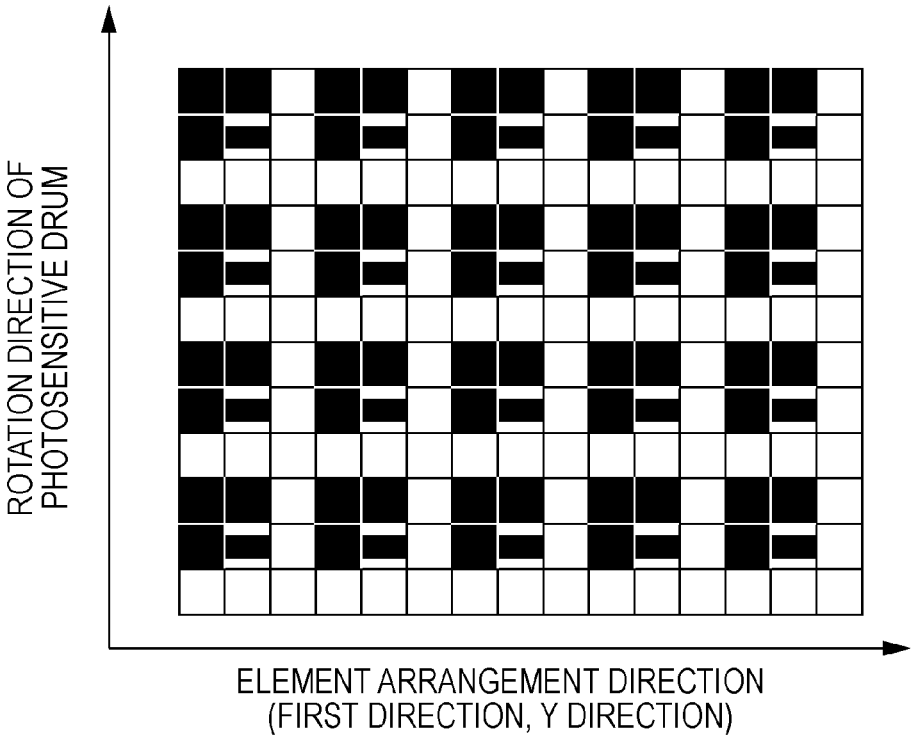
FIGS. 7A and 7B are diagrams for explaining an area gray scale method when performing pulse width modulation.
Figure 7B:
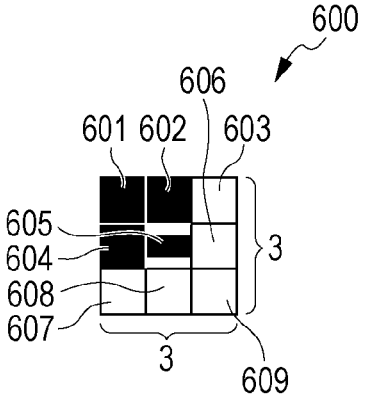

First, the gray scale representation by a combination of the binary area gray scale method and the pulse width modulation method will be described with reference to FIG. 7. In FIG. 7B, nine block elements present in a unit cell 600 in an electrostatic latent image formed by the exposure head are referred to as pixels (601 to 609). In this way, by using a unit cell 600 of 3×3 pixels (equivalent to 600 dpi of 200 lpi) as one unit, a halftone image as illustrated in FIG. 7A is formed by a plurality of unit cells 600. The three pixels aligned in the column direction in the unit cell 600 correspond to an exposure position of the same organic EL element 302 and the exposed position on the photosensitive drum 10 changes according to the rotation of the photosensitive drum 10. In the same manner, the 12 pixels aligned in the same column in FIG. 7A correspond to an exposure position of the same organic EL element 302.

The pixel 605 in the unit cell 600 is a pixel where the pulse width modulation is performed and referred to as a gray scale control pixel. However, the gray scale control pixel is at least one pixel selected from the pixels in the unit cell 600 and is appropriately determined by a dither method or an error diffusion method which is an area gray scale method.

In FIG. 7B, a black portion is an exposed position and a white portion is an unexposed portion. Specifically, in the unit cell 600 of FIG. 7B, the pixels 601, 602, and 604 are exposed and the pixels 603, 606, 607, 608, and 609 are not exposed. The pixel 605 is in a state in which a part of the pixel, specifically, a portion extending in the vertical direction from the center of the pixel, is exposed, and the other portions are not exposed.

In a configuration that does not include the gray scale control pixel, in other words, when the gray scale is represented by only a binary area gray scale method, one pixel has only a binary pattern of an exposed state and an unexposed state, so that a unit cell can represent only 3×3=9 gray scales.

However, when the gray scale control pixel 605 is included in the unit cell 600, the light emitting control as described below can be performed. That is, it is possible to create an intermediate state in which a part is exposed and the other part is not exposed, in addition to the exposed state and the unexposed state, in each pixel. As a result, for example, it is possible to assign a data signal of 4 bits to the organic EL element 302 corresponding to each pixel, so that it is possible to obtain a gray scale representation of $3\times3\times2^4=144$ gray scales by controlling the exposure time.

Figure 8A:
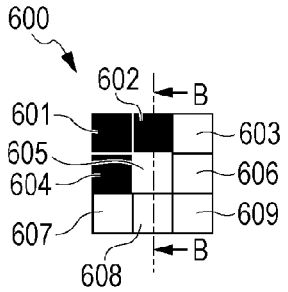
FIGS. 8A to 8I are diagrams for explaining gray scale change when performing pulse width modulation.
Figure 8B:
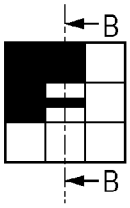
Figure 8C:
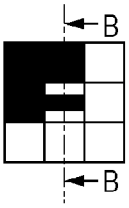
Figure 8D:
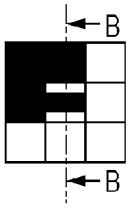
Figure 8E:
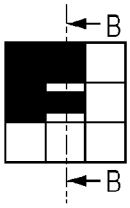
Figure 8F:
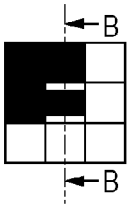
Figure 8G:
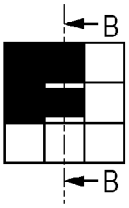
Figure 8H:
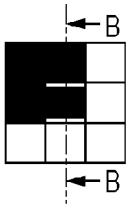

The gray scale control pixel 605 will be described in more detail with reference to FIG. 8. FIG. 8A illustrates an exposure state corresponding to an area gray scale signal of the unit cell 600 when the gray scale is 48 of the 144 gray scales. When the gray scale is increased by two from the area gray scale signal of FIG. 8A, the state illustrated in FIG. 8B appears. Specifically, FIG. 8B illustrates a state in which, when the exposure time corresponding to the maximum gray scale value that can be represented by one pixel is 1 (=16/16), the exposure time of the gray scale control pixel 605 is increased by 2/16 from that of FIG. 8A. FIG. 8B illustrates an exposure state in which the unit cell 600 corresponds to a gray scale of 50. In the same manner, FIGS. 8C to 8I illustrate states in which the gray scale is increased by two from that in the previous figure. Specifically, FIGS. 8A to 8I illustrate halftone image patterns when the gray scale is 48, 50, 52, 54, 56, 58, 60, 62, and 64, respectively.

Figure 8I:
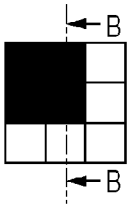

Further, it is possible to represent halftone image patterns of gray scales 65 to 80, in FIG. 8I, by using the pixel 603 as the gray scale control pixel and controlling the exposure time of the pixel 603. In this way, the gray scales from 1 to 144 can be represented.

FIG. 8 illustrates a center-growth type pulse width modulation method in which the exposure time is controlled so that the exposed area extends from the center of the gray scale control pixel 605 to both ends of the gray scale control pixel 605. In addition to the above method, there is an end-growth type pulse width modulation method in which the exposure time is controlled so that the exposed area extends from one end to the other end of the gray scale control pixel 605.

Figure 9A:
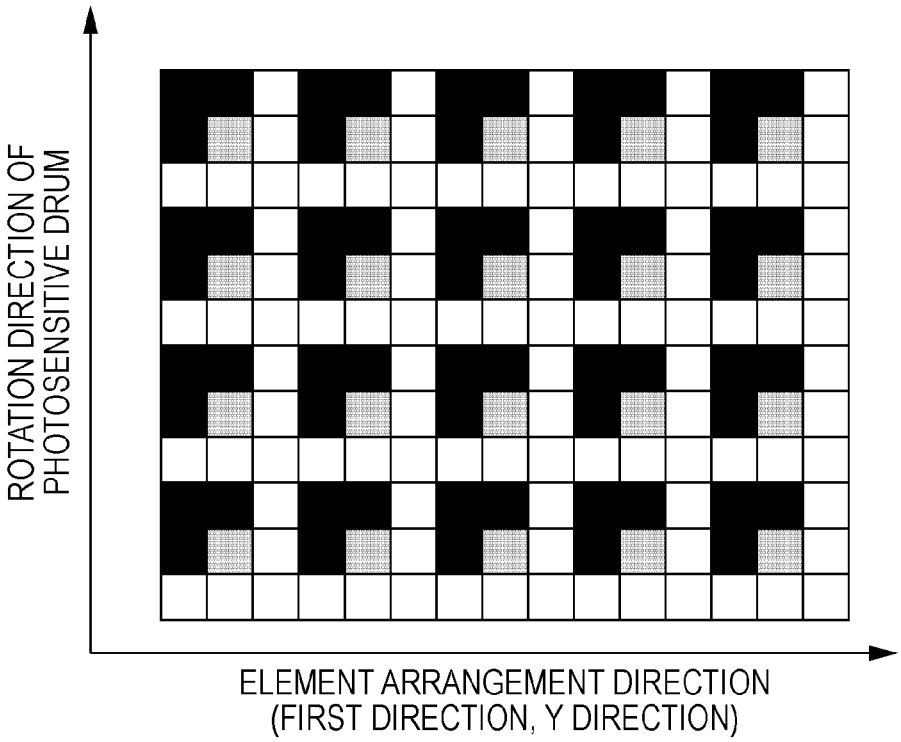
FIGS. 9A and 9B are diagrams for explaining area gray scale method when performing amplitude modulation.

Next, the gray scale representation by a combination of the binary area gray scale method and the amplitude modulation method will be described with reference to FIG. 9. In the same manner as in the method using the pulse width modulation method described above, in FIG. 9B, the gray scale of one unit cell 700 is represented as pixels (701 to 709) by nine block elements present in the unit cell 700 in an electrostatic latent image formed by the exposure head 30. The halftone image as illustrated in FIG. 9A is formed by a plurality of unit cells 700. The three pixels aligned in the column direction in the unit cell 700 correspond to an exposure position of the same organic EL element 302 and the exposed position on the photosensitive drum 10 changes according to the rotation of the photosensitive drum 10. In the same manner, the 12 pixels aligned in the same column in FIG. 9A correspond to an exposure position of the same organic EL element 302.

A gray scale control pixel 705 is provided in the unit cell 700, so that the number of gray scales that can be represented is increased. Specifically, the amount of current of the organic EL element 302 corresponding to the gray scale control pixel 705 is controlled so that the gray scale control pixel 705 can have a plurality of values as the luminance value per unit time. By this configuration, the gray scale control pixel 705 has a plurality of values of luminance per unit time. Also in this configuration, it is possible to assign a data signal of 4 bits to the organic EL element 302 corresponding to each pixel, so that it is possible to obtain a gray scale representation of $3\times3\times2^4=144$ gray scales equivalent to 600 dpi of 200 lpi by controlling the exposure time.

Figure 9B:
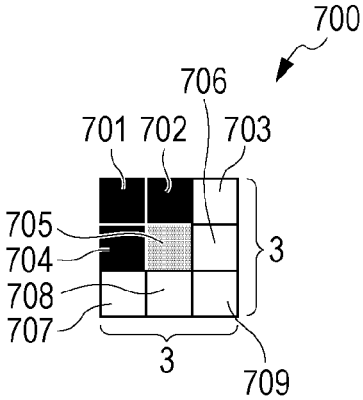

FIG. 9B illustrates an exposure state corresponding to the area gray scale signal of a gray scale of 56 among 144 gray scales. In FIG. 9B, a black portion is a portion exposed by a maximum luminance value and a gray portion is a portion exposed by half the maximum luminance value. In this way, different from the pulse width modulation method, the gray scale control pixel 705 is not in a state in which the exposed state and the unexposed state are mixed and the gray scale control pixel 705 is in a state in which the entire pixel is exposed but the amount of exposure is smaller than that of the pixel 701. The luminance per unit time of the organic EL element 302 corresponding to the gray scale control pixel 705 in the unit cell 700 is set to a value other than the maximum luminance value or the minimum luminance value by the drive circuit 303. On the other hand, the luminance per unit time of the organic EL element 302 corresponding to a pixel (for example, 701 or 709) other than the gray scale control pixel 705 is set to the maximum luminance value or the minimum luminance value by the drive circuit 303.

However, in the same manner as in the pulse width modulation method, the gray scale control pixel 705 is at least one pixel selected from the pixels in the unit cell 700 and is determined by a dither method or an error diffusion method which is an area gray scale method.

Figure 10A:
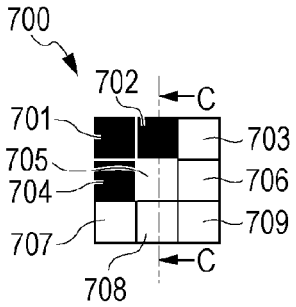
FIGS. 10A to 10I are diagrams for explaining gray scale change when performing amplitude modulation.
Figures 10B, 10C, 10D, 10E:
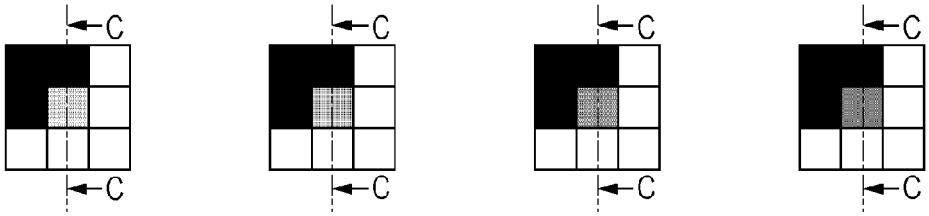

The gray scale control pixel 705 will be described in detail with reference to FIG. 10. FIG. 10A illustrates an exposure state corresponding to the area gray scale signal of the unit cell 700 when the gray scale is 48. When the gray scale is increased by two from the area gray scale signal of FIG. 10A, the state illustrated in FIG. 10B appears. Specifically, FIG. 10B illustrates a state in which, when the maximum amplitude value corresponding to the maximum gray scale value that can be represented by one pixel is 1 (=16/16), the amplitude value of the gray scale control pixel 705 is increased by 2/16 from that of FIG. 10A. The gray scale of the unit cell 700 becomes a gray scale of 50. In the same manner, FIGS. 10C to 10I illustrate states in which the gray scale is increased by two from that in the previous figure. Specifically, FIGS. 10A to 10I illustrate halftone image patterns when the gray scale is 48, 50, 52, 54, 56, 58, 60, 62, and 64, respectively.

Figures 10F, 10G, 10H, 10I:
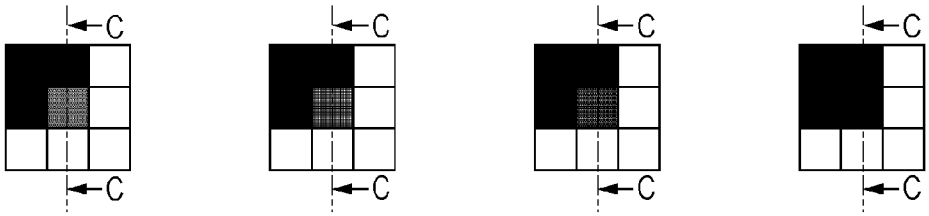

Further, it is possible to represent halftone image patterns of gray scales 65 to 80, in FIG. 10I, by using the pixel 703 as the gray scale control pixel and controlling the amount of exposure (amplitude value) of the pixel 703. In this way, the gray scales from 1 to 144 can be represented.

Exposure simulation results of cases, in which the binary area gray scale method is combined with the center-growth type pulse width modulation method and the amplitude modulation method, respectively, as a multi-value area gray scale method, are compared.

Figure 11:
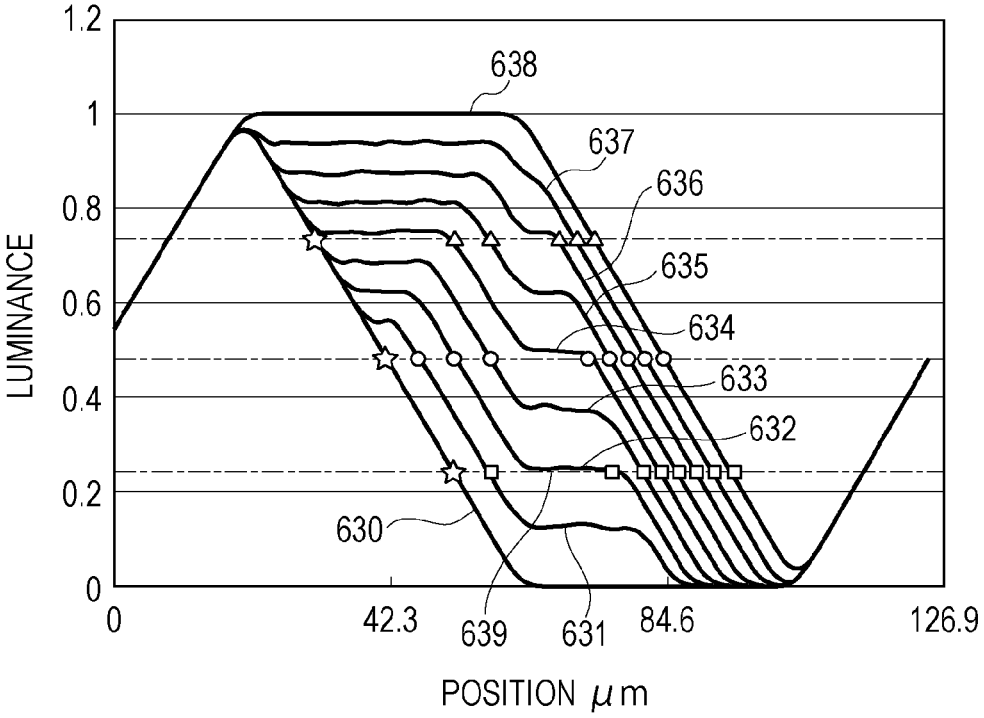
FIG. 11 is a cross-sectional view of exposure distribution for each gray scale by pulse width modulation.

FIG. 11 illustrates a simulation result of exposure distribution cross-sections in the B-B cross-sections of the unit cells 600 in FIG. 8 when performing exposure according to a gray scale pattern using the method illustrated in FIG. 7. In FIG. 11, the horizontal axis represents position and the vertical axis represents luminance. The lines 630 to 638 in FIG. 11 correspond to the exposure distribution cross-sections in FIGS. 8A to 8I, respectively.

Figure 12:
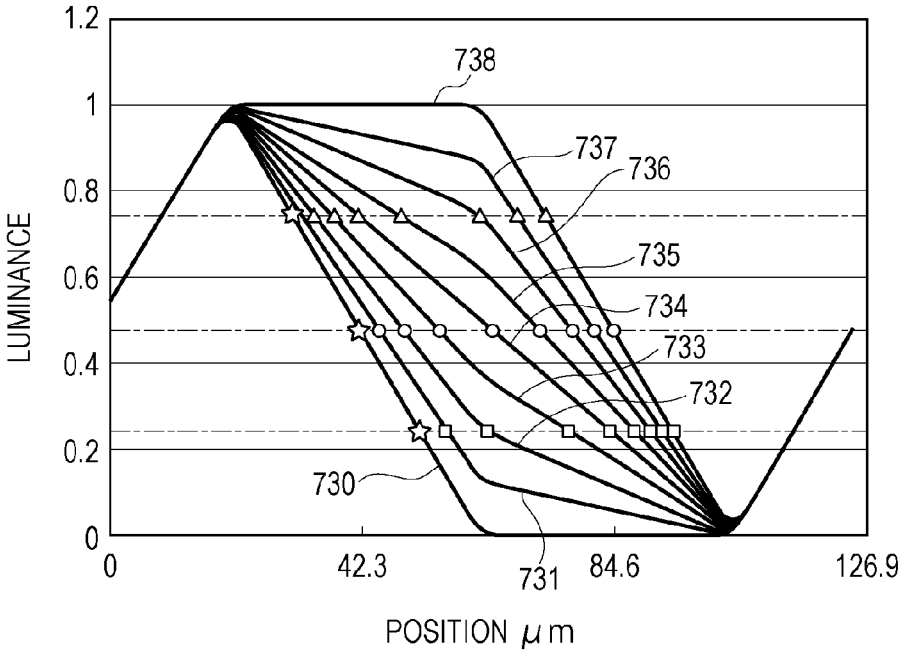
FIG. 12 is a cross-sectional view of exposure distribution for each gray scale by luminance modulation.

On the other hand, FIG. 12 illustrates a simulation result of exposure distribution cross-sections in the C-C cross-sections of the unit cells 700 in FIG. 10 when performing exposure according to a gray scale pattern using the method of the embodiment illustrated in FIG. 9. The lines 730 to 738 in FIG. 12 correspond to the exposure distribution cross-sections in FIGS. 10A to 10I, respectively.

In the above exposure simulations, the exposure distribution is calculated as an output when a spot shape after passing the lens group 310 described later is inputted corresponding to any area gray scale signal. Specifically, a fast Fourier transform is applied to an exposure image pattern formed by the input spot shape and the area gray scale signal and the exposure image pattern is convoluted. The input spot shape is standardized by an accumulated light amount per unit pixel when a full exposure is performed. The simulations are performed by forming the light emitting area of the organic EL element 302 into 42 μm×42 μm.

When comparing FIG. 11 and FIG. 12, it is known that the multi-value area gray scale method using the amplitude modulation method of the embodiment forms a more stable image against environment variation than the multi-value area gray scale method using the center-growth type pulse width modulation method. The reason of the above will be described below.

In FIGS. 11 and 12, variation of exposure distribution at a predetermined luminance value used as a threshold value is described. A star (★) indicates a point of intersection between the luminance values 0.25, 0.5, and 0.75 and a curve 630 in FIG. 11 or a curve 730 in FIG. 12. In the same manner, points of intersection between curves 631 to 638 in FIG. 11 or curves 731 to 738 in FIG. 12 and the luminance values 0.5, 0.25, and 0.75 are indicated by a circle (○), a square (□), and a triangle (Δ), respectively. The distance between each sign (○, □, Δ) and the sign (★) is defined as a line width variation and the line width variation is evaluated for each gray scale. The reason why the distance between the star (★) and each sign (○, □, Δ) in FIGS. 11 and 12 is defined as the line width variation will be described below.

In the electrophotographic image forming device, an electrostatic latent image is formed on the photosensitive drum 10 by irradiating light based on an image signal. Therefore, when the exposure distribution on the photosensitive drum 10 irradiated with light changes, latent image potential on the photosensitive drum 10 also changes. Therefore, by considering the change of the exposure distribution, it is possible to estimate the change of the latent image potential on the photosensitive drum 10. The luminance value 0.5 of the exposure distribution indicated here corresponds to a voltage value applied to the developing roller 21 described above. When a curve corresponding to the exposure distribution cross-section is located in an area higher than the luminance value 0.5, in other words, when the curve is higher than the alternate long and short dash line in FIG. 11 or FIG. 12, toner is attached to the exposure position and the exposure position becomes a development portion. When the curve corresponding to the exposure distribution cross-section is located in an area lower than the luminance value 0.5, in other words, when the curve is lower than the alternate long and short dash line in FIG. 11 or FIG. 12, toner is not attached to the exposure position and the exposure position becomes a non-development portion. In short, the luminance value is a threshold value between the development portion and the non-development portion. Therefore, it is possible to evaluate the line width variation (the distance between the sign ★ and the sign ○ in FIGS. 11 and 12) of the point of intersection between the luminance value which is the threshold value and the curve corresponding to the exposure distribution cross-section as a variation of the image. It is possible to know the stability of the gray scale presentation by the change rate of the variation.

The luminance value 0.75 and the luminance value 0.25 represent a change of the developing bias under a high temperature and high humidity environment and a low temperature and low humidity environment. It is possible to evaluate the stability of the gray scale presentation under varying environment by comparing the changes of the line width variation (the distance between the sign ★ and the sign □ or Δ in FIGS. 11 and 12) at the luminance values 0.75 and 0.25.

Figure 13:
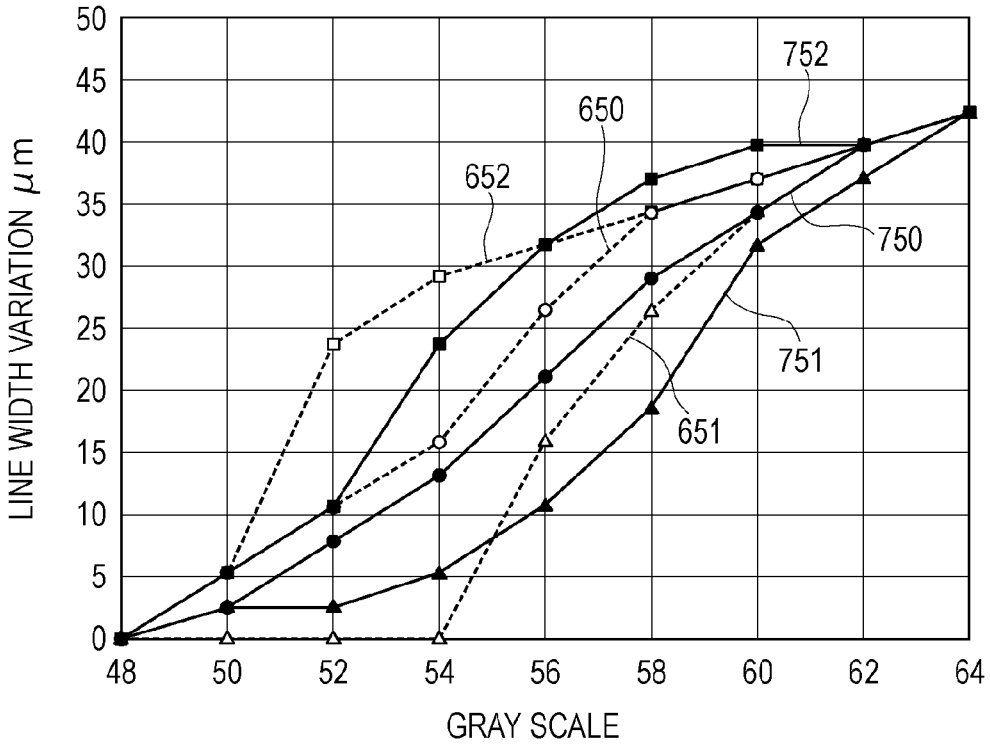
FIG. 13 is a relationship diagram between gray scale and line width variation in pulse width modulation and luminance modulation.

FIG. 13 illustrates a relationship between the gray scale using the amplitude modulation or the gray scale of the center-growth type pulse width modulation and the line width variation. The dashed lines indicate a relationship between the line width variation and the gray scale in the center-growth type pulse width modulation illustrated in FIG. 11. More specifically, the dashed line 650 indicates the relationship between the line width variation and the gray scale when the luminance value is 0.5, the dashed line 651 indicates the relationship between the line width variation and the gray scale when the luminance value is 0.75, and the dashed line 652 indicates the relationship between the line width variation and the gray scale when the luminance value is 0.25. On the other hand, the solid lines indicate a relationship between the line width variation and the gray scale in the amplitude modulation illustrated in FIG. 12. More specifically, the solid line 750 indicates the relationship between the line width variation and the gray scale when the luminance value is 0.5, the solid line 751 indicates the relationship between the line width variation and the gray scale when the luminance value is 0.75, and the solid line 752 indicates the relationship between the line width variation and the gray scale when the luminance value is 0.25.

As illustrated in FIG. 13, when comparing the dashed line 650 and the solid line 750, the change of the inclination (the change of the line width variation) of the solid line 750 is smaller than that of the dashed line 650 and is relatively close to a constant inclination. Therefore, at the luminance value 0.5, when the amplitude modulation method is used, it is possible to perform more stable gray scale representation than when the pulse width modulation method is used.

When the luminance value becomes 0.25 or 0.75 due to environmental variation, a difference caused by difference of the gray scale representation occurs. In the center-growth type pulse width modulation, when the gray scale is 54, the difference between the line width variation when the luminance value is 0.25 and the line width variation when the luminance value is 0.75 is the greatest and the value of the difference is 29 μm. On the other hand, in the amplitude modulation, when the gray scale is 56, the difference is the greatest and the value of the difference is 21 μm. This result means that the line width variation with respect to the variation of the threshold luminance value is smaller in the amplitude modulation than in the center-growth type pulse width modulation. In summary, it can be said that the amplitude modulation method can perform more stable gray scale representation against environmental variation than the pulse width modulation.

In the dashed line 651 in FIG. 13, the line width variation is zero from the gray scales 48 to 54. The line width variation is not zero from gray scale 56. Therefore, if the threshold luminance value becomes 0.75 due to environmental variation, a gray scale image of the gray scales from 48 to 54 are developed at the gray scale 48, so that gray scales are lost, in other words, a tone jump occurs, and a defect occurs in a formed image. On the other hand, in the solid line 751, the line width variation is present from the gray scales 48 to 54, so that no gray scale is lost. Also in this point, when the amplitude modulation is used, it is possible to form an image more stably against environmental variation than when the center-growth type pulse width modulation is used.

This is because the curve corresponding to the exposure distribution cross-section of the electrostatic latent image for each gray scale formed by the center-growth type pulse width modulation illustrated in FIG. 11 has a step-shaped portion. The line width suddenly changes at the step-shaped portion. As known from the sign □ on the curve 632 (curve of gray scale 52) in FIG. 11, the sign □ on the curve 632 is far away from the sign □ on the curve 631 (curve of gray scale 50). This is because the curve 632 (curve of gray scale 52) largely changes at the position of the step-shaped portion 639 and largely extends rightward in FIG. 11. In FIG. 11, the curves 631 to 636 have a step-shaped portion in a range where the luminance is greater than 0 and smaller than 1, so that there is a position at which when the threshold value changes, the line width variation largely changes. Therefore, a tone jump occurs due to setting of the threshold value or environmental variation. On the other hand, as illustrated in FIG. 12, in the amplitude modulation, the curves corresponding to the exposure distribution cross-sections have no step-shaped portion, so that the tone jump is difficult to occur.

Although the gray scales 48 to 64 are described here as an example, it has also been confirmed that the amplitude modulation is more stable than the pulse width modulation in all gray scales other than the above gray scales.

In this way, it is possible to realize an image forming device having high stability against environmental variation at low cost by combining the amplitude modulation with the binary area gray scale as a gray scale representation of the exposure head 30.

Figure 14:
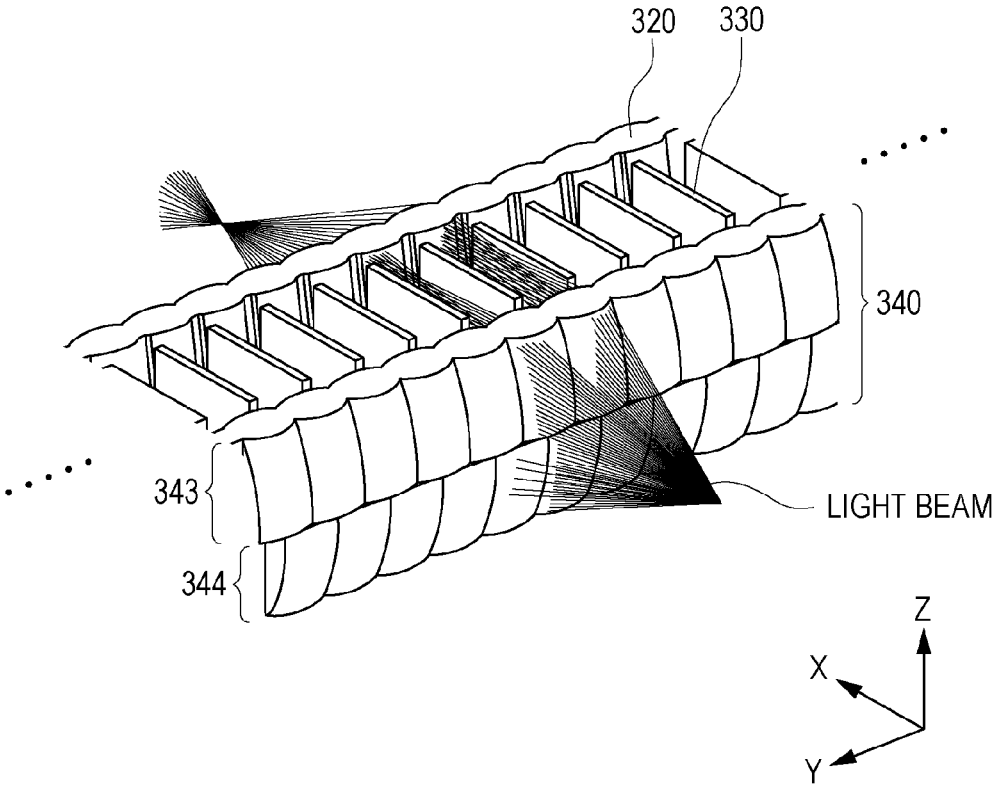
FIG. 14 is a diagram illustrating an example of a lens group of the exposure head of the embodiment.

Next, the lens group 310 according to the embodiment will be described. FIG. 14 illustrates a configuration of the lens group 310 according to the embodiment. The lens group 310 includes a first lens array 320 and a second lens array 340 arrayed in the X direction. The second lens array 340 includes a first lens row 343 and a second lens row 344 arrayed in the Z direction. The first lens array 320 also has the same configuration. Each of the first lens row 343 and the second lens row 344 has a plurality of lenses arrayed in the Y direction.

In the embodiment, the X direction is referred to as an optical axis direction, the Y direction is referred to as a main array direction, and the Z direction is referred to as a sub-array direction. The main array direction is in parallel with a longitudinal direction in which the organic EL elements 302 are one-dimensionally arrayed in the element array 301. The sub-array direction is a direction corresponding to the rotation direction of the photosensitive drum 10.

A plurality of light shielding members 330 are arranged between the first lens array 320 and the second lens array 340. The light shielding member 330 plays a role of shielding a part of light beams (stray light that does not contribute to image formation) that pass through a lens in the first lens array 320 and enter a lens in the second lens array 340 in a main array cross-section.

A row of optical axes of each of a plurality of lenses (optical axis row) included in the second lens array 340 is positioned on the same line included in a surface between the first lens row 343 and the second lens row 344 in the second lens array 340. The first lens array 320 also has the same configuration. Further, the row of optical axes of each of a plurality of lenses (optical axis row) included in the first lens array 320 is positioned higher than the same line included in the surface between the first lens row 343 and the second lens row 344 in the second lens array 340. Thereby, in a ZX cross-section (hereinafter referred to as a main array cross-section) which is a cross-section perpendicular to the main array direction, a system is formed in which an inverted image of an object is formed and a level shift array (zigzag array) is realized. Hereinafter, a system that forms an erect unmagnification image of an object is referred to as an erect equal-magnification imaging system and a system that forms an inverted image of an object is referred to as an inverted imaging system.

The "level shift array (zigzag array)" in the embodiment is defined as follows: The level shift array is a configuration in which, in a configuration in which one lens array includes a plurality lens rows, optical axes of a plurality of lenses included in each of the plurality of lens rows do not correspond to each other in lenses adjacent to each other in the sub-array direction, are away from each other in the main array direction, and are located on the same line. Here, the lenses adjacent to each other in the sub-array direction are lenses closest to each other in the sub-array direction. The "adjacent to each other" includes a configuration in which lenses arranged in the sub-array direction are in contact with each other and a configuration in which lenses arrayed in the sub-array direction are arrayed with an intermediate in between.

Next, the lens group 310 used in the present invention will be described in detail with reference to FIGS. 15 and 16 by using specific numerical values. FIGS. 15A to 15C are main part schematic diagrams of the lens group 310 according to the embodiment. FIGS. 15A to 15C illustrate an XY cross-section, a ZX cross-section (main array cross-section), and a YZ cross-section (hereinafter referred to as a sub-array cross-section) of the lens group 310, respectively.

Figure 15A:
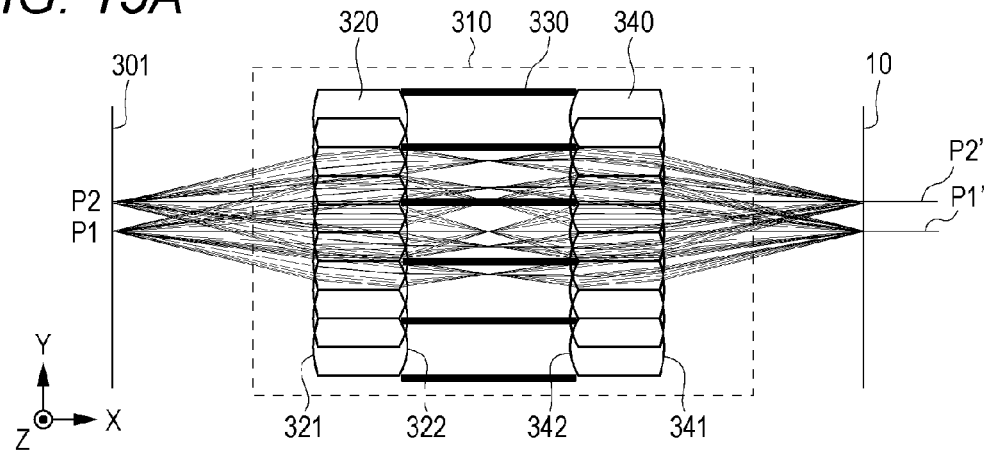
FIGS. 15A to 15C are diagrams for explaining an image formation system of the lens group of the embodiment.

As illustrated in FIG. 15A, light beams which are emitted from one light emitting point on the element array 301 and pass through each lens are collected to one point on the photosensitive drum 10. For example, light beams from a light emitting point P1 on the element array 301 are collected to P1' and light beams from a light emitting point P2 are collected to P2'. By this configuration, it is possible to perform exposure corresponding to a light emitting state of the light emitting points on the element array 301. Regarding the light emitting points on the element array 301, there is a plurality of light emitting points arrayed at regular intervals in the main array direction and the interval between the light emitting points adjacent to each other is several tens of μm. The interval between the light emitting points adjacent to each other is sufficiently smaller than the interval between lenses adjacent to each other in the main array direction (several hundreds of μm), so that it can be assumed that the light emitting points are substantially continuously present.

Figure 15B:
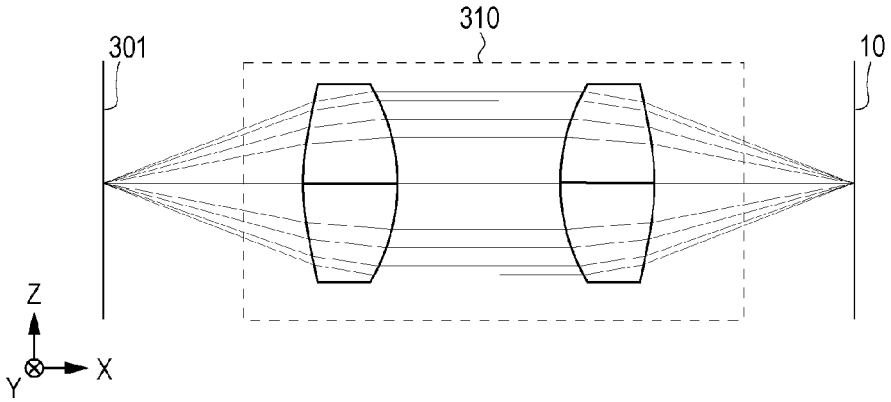

Each light emitting point on the element array 301 forms an erect unmagnification image in the main array cross-section illustrated in FIG. 15A and forms an inverted image in the sub-array cross-section illustrated in FIG. 15B. As illustrated in FIG. 15C, each lens array (for example, the second lens array 320) includes two lens rows, which are an upper row (the first lens row 343) and a lower row (the second lens row 344), in the sub-array direction. An optical axis of each lens included in the upper row is indicated by a black circle (●) and an optical axis of each lens included in the lower row is indicated by an inverted triangle (▽). An array pitch p of the lenses in the lens row in the main array direction is 0.76 mm in both upper and lower rows.

Figure 15C:
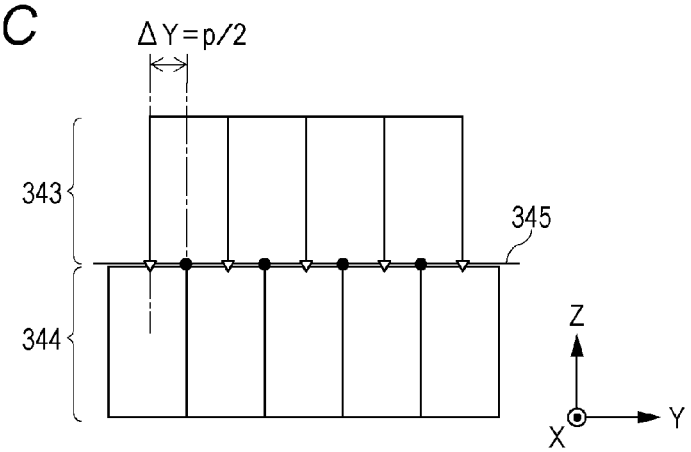

Here, as illustrated in FIG. 15C, the optical axes of the upper row and the optical axes of the lower row are located on the same line 345 (optical axis row). When the same line is at Z=0, lens surfaces of the lower row are located in a range of Z=−1.22 mm to 0 mm and lens surfaces of the upper row are located in a range of Z=0 mm to 1.22 mm. Further, the upper row and the lower row are shifted from each other by ΔY in the main array direction, so that the optical axes of the upper row and the optical axes of the lower row are arranged zigzag away from each other in the main array direction. Here, the shortest distance ΔY between an optical axis in the upper row and an optical axis in the lower row is the shortest distance from an optical axis of one lens in the lower row to an optical axis of a lens in the upper row closest to the optical axis in the lower row in the main array direction. In the embodiment, the shortest distance ΔY is a half of the array pitch p in the main array direction of lenses, so that ΔY=p/2=0.38 mm.

Each (321, 322, 341, and 342) of light incident surfaces and light emitting surfaces of the lenses in the first lens array 320 and the second lens array 340 illustrated in FIG. 15A is formed by an anamorphic aspherical surface. Here, when the point of intersection between each lens surface of the lens array and an optical axis (X axis) is defined as the origin, an axis perpendicular to the optical axis in the main array direction is defined as the Y axis, and an axis perpendicular to the optical axis in the sub-array direction is defined as the Z axis, a shape SH of the anamorphic aspherical surface is represented by Expression (1) shown below. Here, $C_{i,j}$ (i is an integer greater than or equal to 0, j is an integer greater than or equal to 0) is an aspherical coefficient.

$$SH=\Sigma C_{i,j}Y^iZ^j \quad (1)$$

Table 1 shows optical design values of each lens. In Table 1, G1 indicates a lens included in the first lens array 320 and R1 indicates a point at which the light incident surface of a lens and the optical axis of the lens intersect each other. R2 indicates a point at which the light emitting surface of a lens and the optical axis of the lens intersect each other. Therefore, G1R1 indicates a point at which the light incident surface 321 of a lens included in the first lens array 320 and the optical axis of the lens intersect each other. Further, G1R2 indicates a point at which the light emitting surface 322 of a lens included in the first lens array 320 and the optical axis of the lens intersect each other. The same goes for G2R1 and G2R2.

TABLE 1

| light source wavelength | 780 nm | aspherical coefficient | G1R1 | G1R2 | G2R1 | G2R2 |
|---|---|---|---|---|---|---|
| G1 refractive index (light source wavelength) | 1.4859535 | C2.0 | 0.5027743 | −0.8254911 | 0.8254911 | −0.5027743 |
| G2 refractive index (light source wavelength) | 1.4859535 | C4.0 | −0.5125937 | 0.2916421 | −0.2916421 | 0.5125937 |
| Interval between object surface and G1R1 | 2.64997 mm | C6.0 | −2.47E−01 | −0.5597057 | 0.5597057 | 0.2471568 |
| Interval between G1R1 and G1R2 | 1.25122 mm | C8.0 | 0.08356994 | −0.01894198 | 0.01894198 | −0.08356994 |
| Interval between G1R2 and G2R1 | 2.16236 mm | C10.0 | −6.92E+00 | −0.7824901 | 0.7824901 | 6.918249 |
| Interval between G2R1 and G2R2 | 1.25122 mm | C0.2 | 0.1564267 | −0.1950417 | 0.1950417 | −0.1564267 |
| Interval between G2R1 and image plane | 2.64997 mm | C2.2 | −0.1587308 | 0.09481253 | −0.09481253 | 0.1587308 |
| effective diameter on intermediate imaging plane | 0.7 mm | C4.2 | −0.1505496 | −0.30002326 | 0.3002326 | 0.1505496 |
| intermediate image formation magnification | −0.45 | C6.2 | 5.66E+00 | 3.065612 | −3.065612 | −5.659195 |

TABLE 1-continued

| light source wavelength | 780 nm | aspherical coefficient | G1R1 | G1R2 | G2R1 | G2R2 |
|---|---|---|---|---|---|---|
| in main array cross-section | | | | | | |
| | | C8.2 | −13.83601 | −6.539772 | 6.539772 | 13.83601 |
| | | C0.4 | −0.03678572 | −0.007561912 | 0.007561912 | 0.03678572 |
| | | C2.4 | 0.1479884 | 0.03211153 | −0.03211153 | −0.1479884 |
| | | C4.4 | −1.037058 | −0.5900471 | 0.5900471 | 1.037058 |
| | | C6.4 | −1.894499 | −0.6987603 | 0.6987603 | 1.894499 |
| | | C0.6 | 1.27E−02 | 0.001105971 | −0.001105971 | −0.01269685 |
| | | C2.6 | −0.07714526 | −0.001013351 | 0.001013351 | 0.07714526 |
| | | C4.6 | 9.71E−01 | 0.4132734 | −0.4132734 | −0.9714155 |
| | | C0.8 | −0.006105566 | −0.00104791 | 0.00104791 | 0.006105566 |
| | | C2.8 | −0.01341726 | −0.0182659 | 0.0182659 | 0.01341726 |
| | | C0.10 | 0.001280955 | 9.61807E−05 | −9.61807E−05 | −0.001280955 |

As shown in Table 1, in the embodiment, an intermediate image formation magnification β (details will be described later) of each lens in the main array cross-section is set to −0.45. However, β may be any value in a range in which an erect equal-magnification imaging system is formed in the main array direction.

Figure 16A:
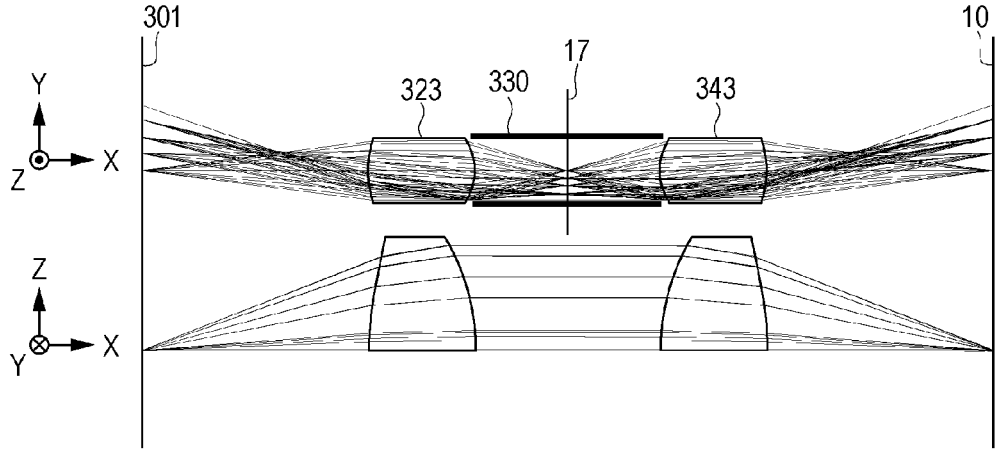
FIGS. 16A and 16B are a main array cross-sectional view and a sub-array cross-sectional view of the lens group according to the embodiment.

FIG. 16A illustrates a main array cross-sectional diagram and a sub-array cross-sectional diagram of an upper row lens optical system including the upper row 323 of the first lens array 320 and the upper row (the first lens row 343) of the second lens array. On the other hand, FIG. 16B illustrates a main array cross-sectional diagram and a sub-array cross-sectional diagram of a lower row lens optical system including the lower row 324 of the first lens array 320 and the upper row (the second lens row 344) of the second lens array.

Figure 16B:
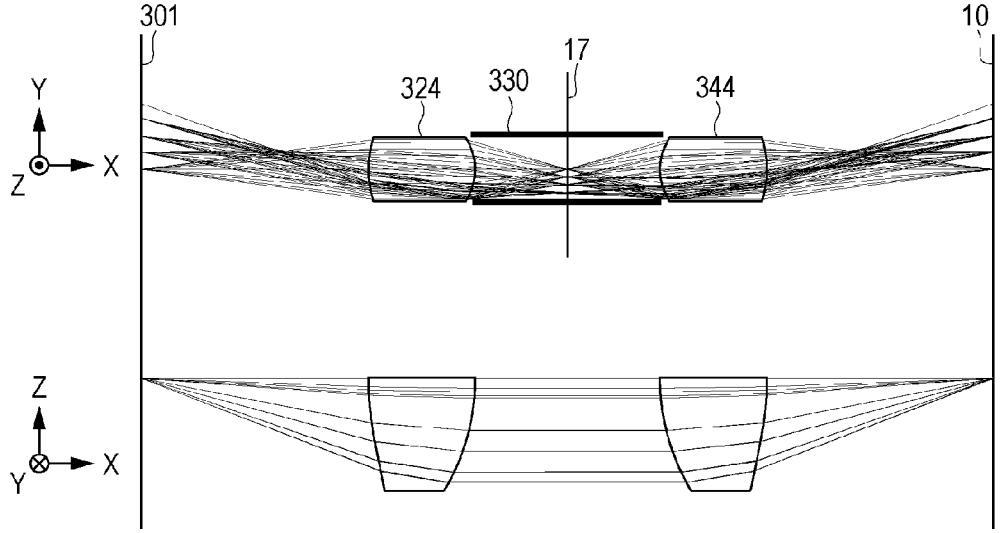

As known from comparison between FIG. 16A and FIG. 16B, the upper row lens optical system and the lower row lens optical system have the same configuration in the main array cross-section and the light beam paths are also the same. On the other hand, in the sub-array cross-section, these lens optical systems have a symmetrical configuration with respect to the optical axis. Each of the upper row lens optical system and the lower row lens optical system includes a first optical system (lens of the first lens array 320) and a second optical system (lens of the second lens array 340) arranged on the same optical axis. Here, an optical system that forms an intermediate image of each light emitting point on the element array 301 is defined as the first optical system and the surface on which the first optical system forms the intermediate image is defined as an intermediate imaging plane 17. An optical system that forms the intermediate image formed on the intermediate imaging plane 17 on the photosensitive drum 10 is defined as the second optical system. In the embodiment, the first optical system includes only lenses in the first lens array 320 and the second optical system includes only lenses in the second lens array 340.

Next, the effects associated with the lenses will be additionally described below. First, the effect of the level shift array (zigzag array) which is a lens array configuration of the embodiment will be described. For comparison, a lens array optical system is considered in which only one row of lens array is arrayed and there is not a plurality of rows of lens arrays in the sub-array direction. In the comparative example, the configuration (optical design values and the like) other than the above is assumed to be the same as that of the lens group according to the embodiment.

Figure 17A:
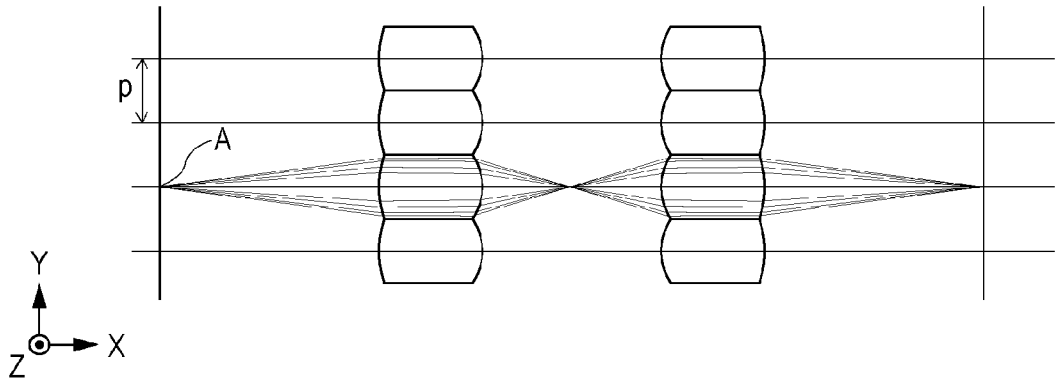
FIGS. 17A to 17C are main array cross-sectional views illustrating image formation light beams from each luminous point of a lens group of a comparative example.
Figure 17B:
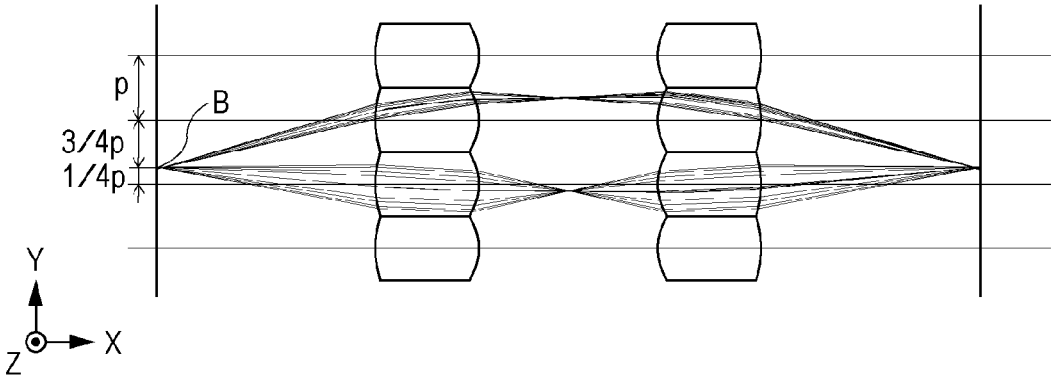
Figure 17C:
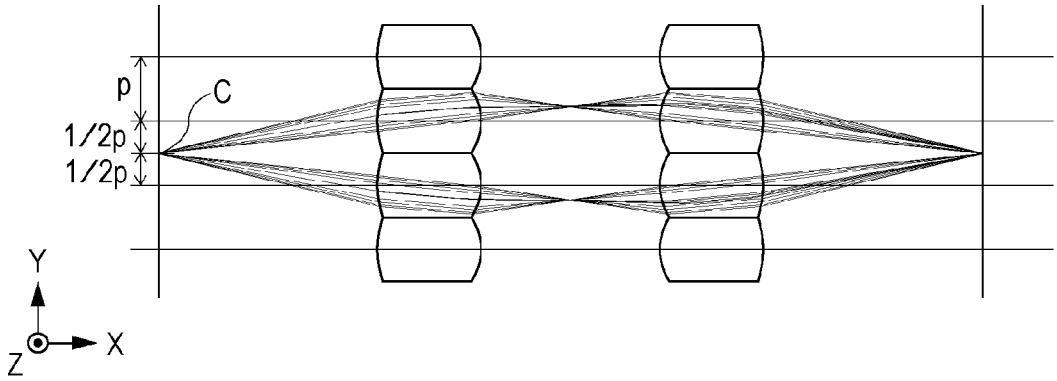

FIG. 17 is diagrams illustrating a sub-array cross-section of the lens group of the comparative example. FIGS. 17A to 17C illustrate a state of an image formation light beam including light beams emitted from different luminous point positions. As illustrated in FIG. 17A, the image formation light beam from the luminous point position A include only a lens light beam of object height 0 of one lens optical system. As illustrated in FIG. 17B, the image formation light beams from the luminous point position B include a lens light beam of object height p/4 of one lens optical system and a lens light beam of object height 3p/4 of a lens optical system adjacent to the one lens optical system. As illustrated in FIG. 17C, the image formation light beams from the luminous point position C include two lens light beams of object height p/2 of two lens optical systems adjacent to each other. In this way, in the comparative example, the number of lens light beams that form the image formation light beams at each luminous point position is small, so that the difference of the light amount between the luminous point positions of one lens light beam largely affects the difference of the image formation light amount.

Figure 18A:
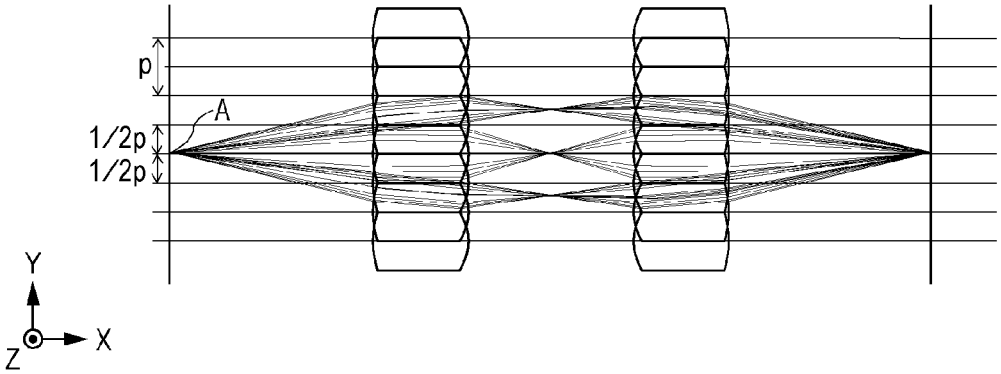
FIGS. 18A to 18C are main array cross-sectional views illustrating image formation light beams from each luminous point position of the lens group according to the embodiment.
Figure 18B:
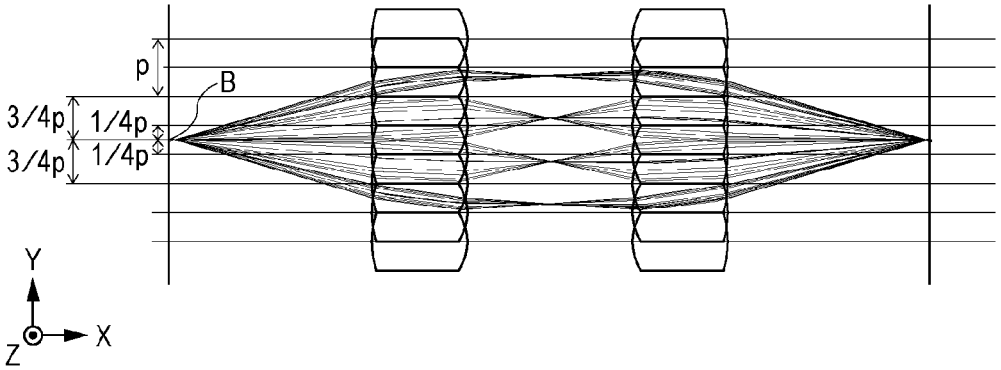
Figure 18C:
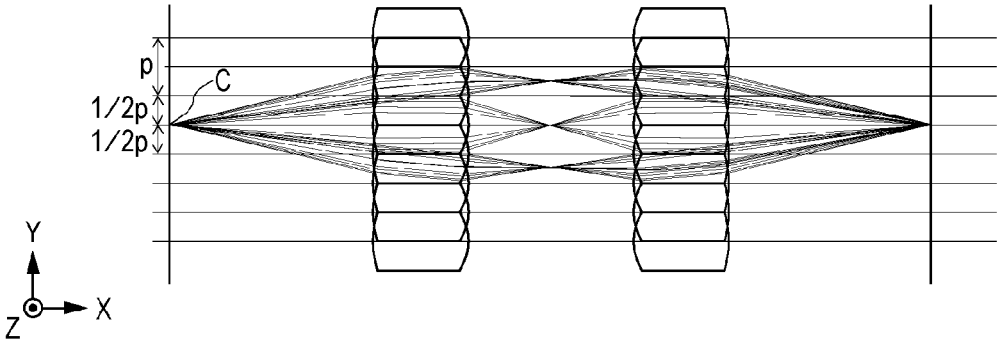

FIG. 18 is diagrams illustrating a sub-array cross-section of the lens group of the embodiment. Each of FIGS. 18A to 18C illustrates a state of image formation light beams including light beams emitted from the same luminous point positions as those in FIGS. 17A to 17C. According to the lens group of the embodiment, the level shift array is applied to the first lens array 320 and the second lens array 340, so that it is possible to increase the number and types (difference of object height) of lens light beams that form image formation light beams. Thereby, it is possible to average the image formation light beams for each luminous point position, so that it is possible to obtain an effect to reduce variation of the image formation light amount and variation of the image formation performance. In particular, in the embodiment, "ΔY=p/2" is set, so that it is possible to cause the image formation light beams at the luminous point position A and the image formation light beams at the luminous point position C to be the same.

Figure 19:
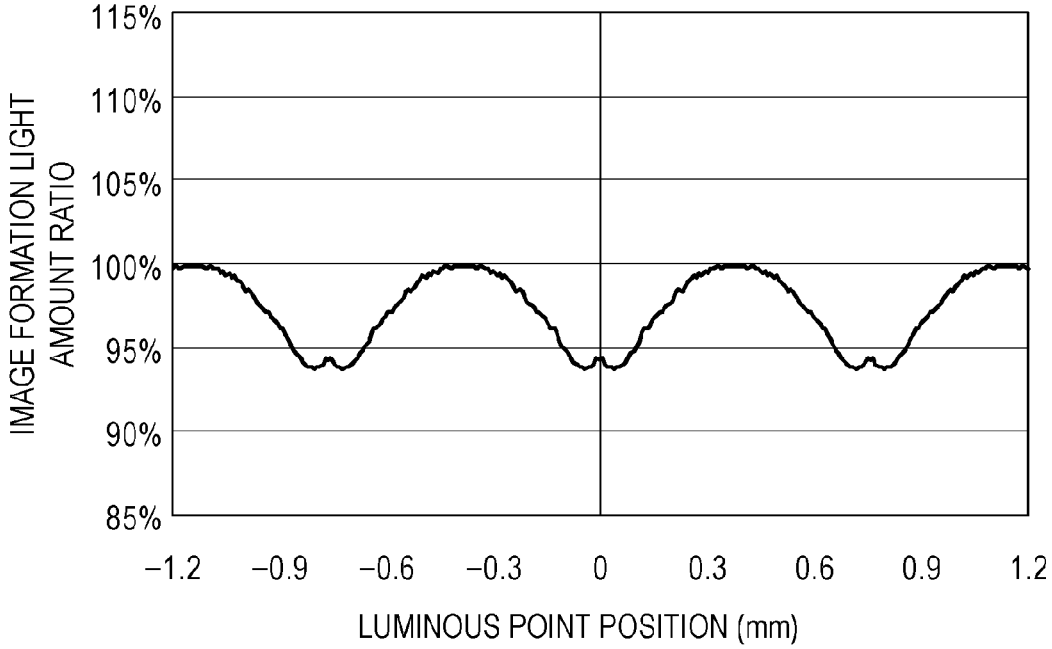
FIG. 19 is a relationship diagram between a luminous point position and an image formation light amount ratio when the lens group according to the comparative example is used.
Figure 20:
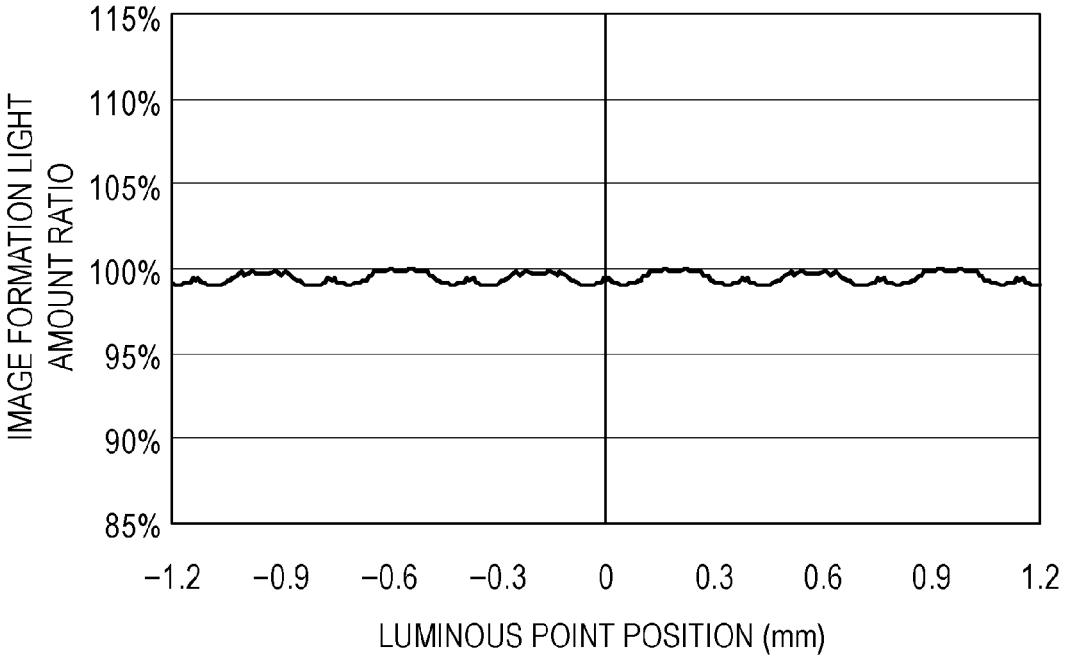
FIG. 20 is a relationship diagram between a luminous point position and an image formation light amount ratio when the lens group according to the embodiment is used.

Next, FIGS. 19 and 20 illustrate a ratio of the image formation light amount corresponding to each luminous point position in order to evaluate the variation of the image formation light amount. FIG. 19 illustrates the ratio of the image formation light amount when the lens group of the comparative example is used. FIG. 20 illustrates the ratio of the image formation light amount when the lens group of the embodiment is used. The image formation light amount of each luminous point position is assumed to be proportional to integration of light use efficiency of the lens light beams that form the image formation light beams and the image formation light amount is normalized by assuming that the image formation light amount of a luminous point position on an optical axis of a certain lens optical system is 100%.

As illustrated in FIG. 19, in the comparative example, the difference between the maximum value and the minimum value of the image formation light amount is 6.2%. On the other hand, as illustrated in FIG. 20, in the embodiment, the difference between the maximum value and the minimum value of the image formation light amount is 1.0%. In other words, it is known that the variation of the image formation light amount in the lens group of the embodiment is smaller than that in the lens group of the comparative example.

As illustrated in FIG. 15, in the main array cross-section, the light beams emitted from a luminous point on the element array 301 pass through the first lens array 320, then form an intermediate image at the intermediate imaging plane 17, pass through the second lens array 340, and form an erect unmagnification image on the photosensitive drum 10. At this time, a paraxial image formation magnification on the intermediate imaging plane in the first lens array 320 is defined as an intermediate image formation magnification β. On the other hand, in the sub-array cross-section, the light beams emitted from a luminous point on the element array 301 pass through the first lens array 320, and then pass through the second lens array 340 without forming an intermediate image, and form an inverted image on the photosensitive drum 10. In this way, the lens group 310 according to the embodiment forms an inverted imaging system in the sub-array direction, so that it is possible to increase a light receiving angle while maintaining the image formation performance. Therefore, the lens group 310 achieves both the image formation light amount and the image formation performance.

Although an example is described in which the lens group 310 includes two lens arrays, that is, the first lens array 320 and the second lens array 340, the lens group 310 is not limited to this. The lens group 310 may include three or more lens arrays arrayed in the X direction. In this case, as described above, at least either one of the first optical system and the second optical system may include two lenses. However, if the lens group 310 includes three or more lens arrays, the number of components increases, so that it is preferable that the lens group 310 includes two lens arrays.

Further, the lens optical system included in the lens group 310 may be formed by one lens array without dividing the lens optical system into the first optical system and the second optical system. Also in this case, it is considered to be able to obtain the effect as described above by forming one lens array into an erect equal-magnification imaging system in the main array cross-section and an inverted imaging system in the sub-array cross-section.

In the embodiment, the shapes of the lenses included in the upper row and the lenses included in the lower row correspond to a shape of a lens obtained by cutting and dividing one lens optical system at the main array cross-sections including the optical axis. In other words, in the main array direction, if the shortest distance ΔY from the optical axis of the lens in the lower row to the optical axis of the lens in the upper row closest to the optical axis of the lens in the lower row is (when the optical axes are not arrayed zigzag), the lens surfaces of the lenses in the upper row and the lenses in the lower row adjacent to each other are configured to be able to be represented by the same expression. Even when the upper row and the lower row are arrayed with an intermediate in between, if the lens surfaces of the upper row and the lower row have shapes that can be represented by the same expression, the lenses can be easily shaped.

As illustrated in FIG. 15, regarding the upper row lens optical system and the lower row lens optical system, the first optical system (lenses of the first lens array 320) and the second optical system (lenses of the second lens array 340) are configured to be symmetrical with respect to the intermediate imaging plane 17. By employing such a configuration, the same member can be used for both optical systems. The openings of the lens surfaces of all the lenses included in the lens group 310 are desired to have a rectangular shape. When the opening surface of the light beams of the object height on the axis of the first optical system and the second optical system is formed into a rectangular shape, it is possible to arrange the lens surfaces close together by reducing the gap as much as possible, so that the light use efficiency can be improved. The rectangular shape here includes a shape in which at least one of the sides of the rectangle is curved and a shape in which the vertexes of the rectangle are eliminated and which is formed into an approximately circular shape or an approximately oval shape.

In the embodiment, a configuration in which the optical axes of all the lenses in each lens row are located on the same line is described. Here, when the size of each luminous point of a light-emitting unit in the sub-array direction in the image forming device is defined as H and the maximum distance between the optical axis rows of each lens row in the sub-array direction is defined as A, it is defined that each optical axis is located on the same line if the following conditional expression (2) is satisfied.

$$\Delta<(1/2)H \quad (2)$$

When the distance between the optical axes in the sub-array direction is within a range defined by the conditional expression (2), images of each lens row are not away from each other, so that the effects of the present invention can be sufficiently obtained. The size H of each luminous point of the light-emitting unit in the sub-array direction is 25.3 μm. Therefore, when the maximum distance Δ between the optical axes in the sub-array direction is smaller than (½)H=(½)×42.3 μm=21.7 μm for all the lenses, the effects of the present invention can be sufficiently obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming device comprising:

a photosensitive body;

a charging unit configured to charge the photosensitive body;

an exposure unit configured to expose the photosensitive body; and a developing unit configured to provide a developer to the photosensitive body, wherein the exposure unit includes a lens group having a plurality of lenses and an element array which is arranged to face the lens group and includes a plurality of pixels arrayed along the lenses, the plurality of the pixels comprise a plurality of subpixels including an organic EL element, a drive circuit includes a plurality of transistor circuits, and the transistor circuits controls a number of the organic EL elements which emit light, and a luminance of light emitted by the organic EL element in the plurality of the pixels.

2. The image forming device according to claim 1, wherein the drive circuit allows one of the organic EL elements of the subpixels to emit light at a luminance other than a maximum luminance and a minimum luminance, and a luminance of organic EL elements other than the one of the organic EL elements is set to the maximum luminance and the minimum luminance.

3. The image forming device according to claim 1, wherein the transistor circuit controls a value of current flowing through the organic EL element.

4. The image forming device according to claim 1, wherein the lens group includes an inverted imaging system in a cross-section perpendicular to the first direction and an erect equal-magnification imaging system in a crosssection perpendicular to a second direction perpendicular to the first direction and an optical axis direction of each lens.

5. The image forming device according to claim 1, wherein the lens group includes a plurality of lens rows arrayed in a second direction perpendicular to the first direction and an optical axis direction of each lens, and optical axes of lenses adjacent to each other among optical axes of a plurality of lenses included in the plurality of lens rows are away from each other in the first direction and located on the same line.

6. The image forming device according to claim 1, wherein the lens group includes a first optical system and a second optical system away from each other in an optical axis direction of each lens.

7. The image forming device according to claim 6, wherein the first optical system and the second optical system have a shape symmetrical with respect to an intermediate imaging plane held by the lens.

8. The image forming device according to claim 6, wherein the lens group includes a light shielding member configured to shield a part of light beams that pass through the first optical system and enter the second optical system in a cross-section perpendicular to a second direction perpendicular to the first direction and an optical axis direction of each lens.

* * * * *